US007683861B2

(12) United States Patent
Scilla

(10) Patent No.: US 7,683,861 B2
(45) Date of Patent: Mar. 23, 2010

(54) ARRANGEMENT FOR DRIVING LED LIGHTING SOURCES

(75) Inventor: Giovanni Scilla, Fontane di Villorba (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 572 days.

(21) Appl. No.: 11/602,181

(22) Filed: Nov. 21, 2006

(65) Prior Publication Data

US 2007/0127239 A1 Jun. 7, 2007

(30) Foreign Application Priority Data

Nov. 22, 2005 (EP) ..... 05425828

(51) Int. Cl.
*G09G 3/30* (2006.01)

(52) U.S. Cl. ..... 345/76; 345/82; 345/83; 345/204; 315/169.3

(58) Field of Classification Search ..... 315/308, 315/307, 149, 150, 291, 224, 185 R; 362/800; 345/55, 76–83, 204
See application file for complete search history.

(56) References Cited

U.S. PATENT DOCUMENTS

| | | | | |
|---|---|---|---|---|
| 6,150,774 | A | 11/2000 | Mueller et al. | |
| 2002/0047642 | A1 | 4/2002 | Miyagawa | |
| 2004/0208011 | A1 | 10/2004 | Horiuchi et al. | |
| 2005/0007035 | A1 | 1/2005 | Sloan et al. | |
| 2006/0028156 | A1 * | 2/2006 | Jungwirth | 315/312 |

FOREIGN PATENT DOCUMENTS

WO WO 2004/100612 4/2004

* cited by examiner

*Primary Examiner*—Douglas W Owens
*Assistant Examiner*—Ephrem Alemu

(57) ABSTRACT

A driving arrangement for a plurality of light emitting diodes (LEDs), comprising a first power supply line (Vcc), a second power supply line (GND) and a set of signal lines (1*a*, 1*b*, 1*c*) for carrying brightness intensity and or chromatic information for the plurality of light emitting diodes (54). In a first possible configuration of use, the first (Vcc) and second (GND) power supply line jointly supply power to an "active" lighting source and the light emitting diodes (54) are driven as a function of the brightness intensity information provided via the signal lines (1*a*, 1*b*, 1*c*). In a second possible configuration of use for driving a "passive" source, the second power supply line (GND) is not used and the brightness of the light emitting diodes (54) is controlled by switching signals applied via the first power supply line (Vcc) and the set of signal lines (1*a*, 1*b*, 1*c*).

21 Claims, 2 Drawing Sheets

ARRANGEMENT FOR DRIVING LED LIGHTING SOURCES

FIELD OF THE INVENTION

Figure 1:
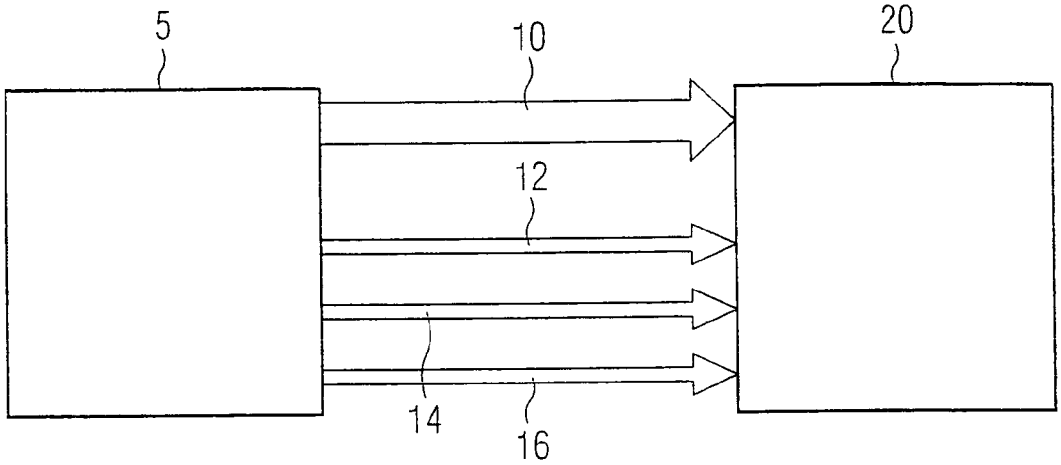

The present invention relates to driving arrangements for lighting sources including a plurality of light emitting diodes (LEDs).

The invention was developed with specific attention paid to its possible use in driving RGB LED sources used as variable brightness lighting sources and in general in driving a multi-chromatic lighting system, e.g. defining a tunable-white lighting system.

DESCRIPTION OF THE RELATED ART

In addition to the use as display units, light emitting diodes (LEDs) are becoming increasingly popular as lighting sources. This applies primarily to so-called high-brightness (or High Flux—HF) LEDs. Typically, these LEDs are arranged in cells, with each cell comprised of one or more LEDs coupled in a parallel/series arrangement.

A combination of a plurality of cells each including one or more LEDs having a given emission wavelength (i.e. respective "colour") produces combined light radiation whose characteristics (spectrum, intensity, and so on) can be selectively adjusted by properly controlling the contribution of each cell. For instance, three cells each including a set of diodes emitting at the wavelength of one of the fundamental colours of a trichromatic system (e.g. RGB) produce white light and/or a radiation of a selectively variable colour. Such arrangements may include cells each comprised of one or more LEDs of essentially the same colour and produce light systems whose intensities may be selectively adjusted to meet specific lighting requirements (for instance providing different lighting levels in different areas of a given space, a display area and so on).

Arrangements adapted for driving a plurality of such cells in association with a single constant current source are known in the art as witnessed, e.g. by WO-A-2004/100612.

Essentially, in these prior art arrangements each cell has an associated switch (typically, an electronic switch) adapted to act as a selectively activatable short-circuit path to the source. When the switch is activated (i.e. the switch is "closed") the LED or LEDs in the associated cell are short-circuited and no radiation is generated by the cell. Conversely, when the switch is de-activated (i.e. the switch is "open") the LED or LEDs in the associated cell are energized and radiation is generated by the cell. The arrangement includes a controller configured to control operation of the switches (typically according to a Pulse Width Modulation—PWM control law). Such an arrangement permits to selectively and automatically adjust the contribution of each cell to the overall light flux produced. Additionally, by resorting to such an arrangement, the current power source is never completely turned off, but only driven through different path.

Currently, the most common types of variable brightness lighting sources can be ascribed to two basic categories, i.e. so-called "passive" and "active" lighting sources.

A "passive" lighting source is e.g. a light emitting diode (LED) source having associated therewith simple and low-cost voltage-to-current converters able to supply the required constant current to the LEDs. As indicated, brightness variations are achieved in these sources by using a Pulse Width Modulation (PWM) technique.

Conversely, an "active" lighting source is e.g. a light emitting diode (LED) source having associated therewith at least one micro-controller able to manage a digital communication with the power supply, and able to control the LED brightness consequently.

Up to now, the two different categories of lighting sources ("passive" and "active") have been typically driven with different and dedicated power supply arrangements.

In general terms, for proper operation of the lighting source, two main functions need be implemented in the arrangement, namely:

- power supply transfer for providing the required power to the light emitting diodes (LEDs), and
- brightness information transfer for controlling the brightness of each colour component (RGB) of the lighting source.

With reference to FIG. 1, a three-chromatic RGB LED source 20, passive or active, is driven by a four-wire supply unit 5. Arrow 10 designates a power supply line, while the other three arrows 12,14,16 correspond to brightness control lines. The unit 5 generates three brightness information signals, one for each colour, and feeds the RGB LED source 20 with these signals. Each one of the brightness signals is able to control the emission state of a respective light emitting diode in the lighting source 20.

Figure 2:
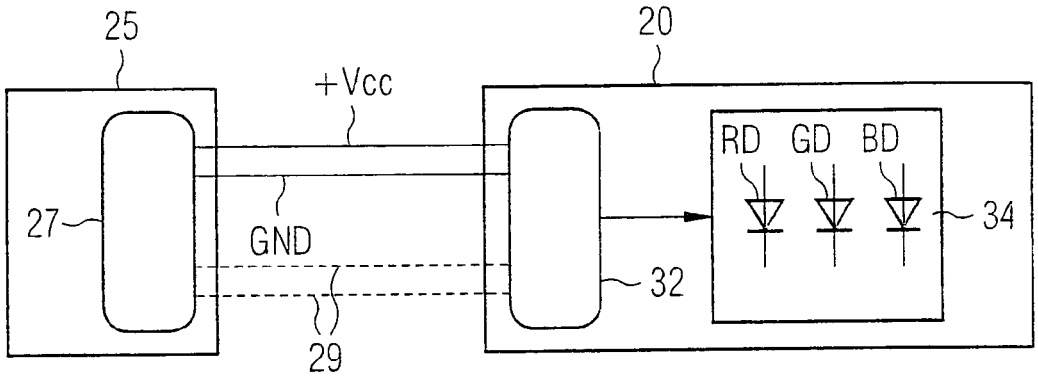

FIG. 2 shows additional detail of a variable brightness lighting arrangement for driving an "active" RGB lighting source 20.

Usually, an "active" lighting source 20 will be associated with a dedicated supply unit 25 equipped with a micro-processor 27. The micro-processor 27 in the supply unit is capable of operating as a digital communication interface and communicates with the micro-processor into the lighting source.

Insofar as power supply proper is concerned, the micro-processor 27 supplies the micro-processor 32 associated with the "active" RGB lighting source 20 via two wires, +Vcc and GND, in order to provide electrical power to the lighting source 30.

Additionally, the micro-processor 27 is configured for sending brightness information signals to the micro-processor 32, by way of serial data BUS lines 29. The corresponding output gates of the micro-processor 27 are thus connected to respective input gates of the micro-processor 32.

The micro-processor 27 thus communicates, via the two serial data BUS lines 29, the brightness information signals to the micro-processor 32. The micro-processor 32 is able to compute the brightness information signals received from the micro-processor 27 in order to properly control a supply block 34 to regulate the respective currents to be delivered to the RD, GD, BD loads.

Thanks to the on-board intelligence available with the light source 20, the arrangement of FIG. 2 optimizes the LED lighting source management, and in particular allows to provide e.g. a thermal feedback protection, an optical feedback, and a compensation of the LED brightness and wavelength production tolerances.

A basic drawback of such an arrangement lies in extra-cost and extra-complexity added.

Figure 3:
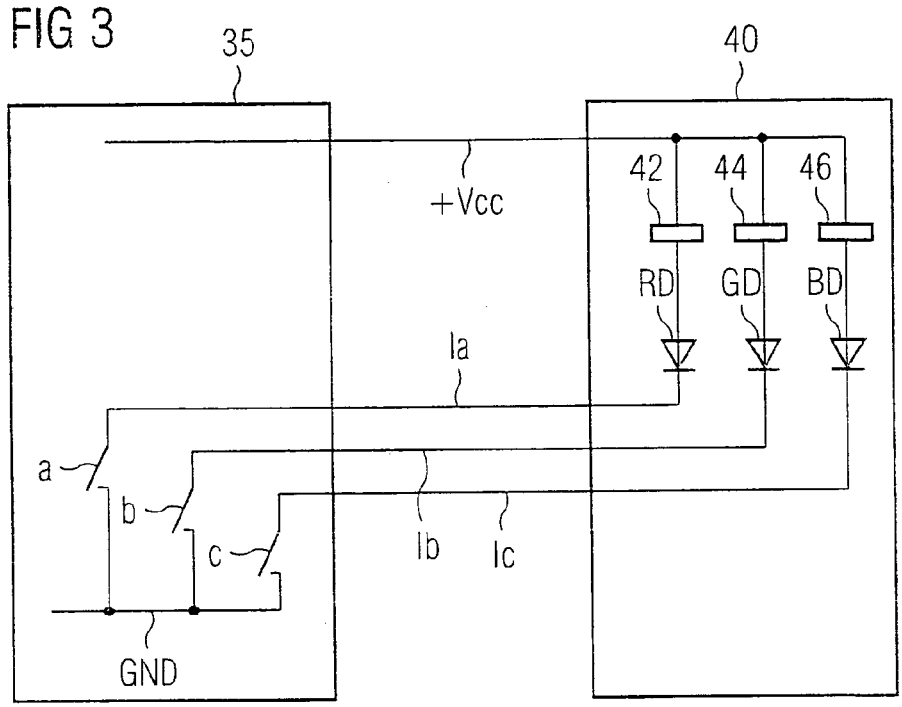

By way of direct comparison, FIG. 3 shows a variable brightness lighting arrangement for driving a "passive" RGB light source 40. This is again based on a four-wire supply unit 35 able to drive a "passive" RGB lighting source 40 via a single power line Vcc plus three lines 1*a*, 1*b* and 1*c* for sending brightness information. Brightness control of the lighting source 40 is achieved by using a PWM modulation technique actuated on three switches a, b, c in the supply unit 35 and associated via the lines 1*a*, 1*b* and 1*c* to respective loads RD, GD, BD represented by the LEDs in the trichromatic source 40. Three voltage-to-current regulators 42, 44, 46 are placed in series to the three diodes RD, GD, and BD included in the lighting source 40.

In the "active" arrangement of FIG. 2 the +Vcc and the GND lines are power-lines, while the two serial data BUS lines are signal-lines.

In the "passive" arrangement of FIG. 3 the power signal and the brightness information signals are in fact fed over the same lines.

As a consequence, while both the arrangements of FIGS. 2 and 3 are "four-wire" arrangements, they are not compatible with each other since the same supply unit is not able to drive indifferently "passive" and "active" lighting sources. In particular, a LED driving arrangement for "passive" sources is not able to drive an "active" source, and vice-versa. Consequently, a "passive" source cannot be interchangeable with an "active" lighting source.

Essentially, the compatibility problem of the "Passive" and "Active" lighting sources cannot be solved with these prior art arrangements.

OBJECT AND SUMMARY OF THE INVENTION

From the foregoing description of the current situation, it emerges that the need exists for arrangements capable of driving LED lighting source in a more satisfactory way as compared to the solutions according to the prior art described previously, especially insofar as the point of possible compatibility is concerned.

The object of the invention is thus to provide a fully satisfactory response to that need.

According to the present invention, that object is achieved by means of an arrangement having the features set forth in the claims that follow.

The claims are an integral part of the disclosure of the invention provided herein.

A preferred embodiment of the invention is thus a driving arrangement for lighting sources including a plurality of light emitting diodes (LEDs), the arrangement including a first power supply line and a set of signal lines for carrying brightness intensity information for said plurality of light emitting diodes, the arrangement including:

- a second power supply line to provide jointly with said first power supply line a two-wire power supply, and
- a switching block to generate switching signals to provide brightness intensity and/or chromatic information for said plurality of light emitting diodes via said set of signal lines.

Such a driving arrangement is thus a flexible, compatible arrangement adapted for driving both "active" and "passive" as described in the foregoing.

In a first possible configuration of use, adopted for driving "active" sources, the first and second power supply line are jointly supply power to the processor included in the "active" lighting sources wherein the processor drives the light emitting diodes in the source as a function of the brightness intensity information provided to the processor via the set of signal lines (typically to the number of three in the diodes comprise an RGB arrangement).

In a second possible configuration of use, adopted for driving "passive" sources, the second power supply line is not used, and the brightness of the light emitting diodes in the source is controlled by switching signals applied thereto via the first power supply line and the set of signal lines.

BRIEF DESCRIPTION OF THE ANNEXED DRAWINGS

The invention will now be described, by way of example only, with reference to the enclosed figures of drawing, wherein:

FIG. 1 to 3, exemplary of the related art, have been described previously, and FIG. 4 is a block diagram of an exemplary embodiment of the arrangement described herein.

DETAILED DESCRIPTION OF PREFERRED EMBODIMENTS OF THE INVENTION

The arrangement described herein essentially uses the same supply unit topology for driving both "passive" and "active" LED lighting sources, such as e.g. RGB LED source.

Figure 4:
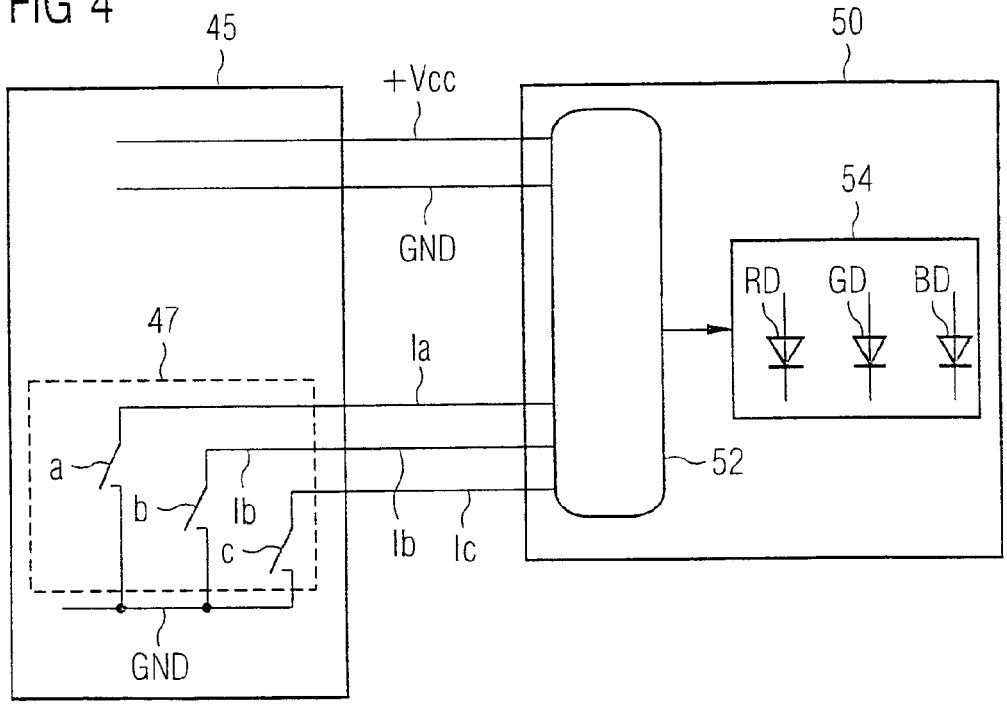

Specifically, with reference to FIG. 4, reference numeral 45 designates a supply unit able to drive both "passive" and "active" RGB LED sources via at least a five-wire arrangement.

In FIG. 4 an "active" RGB LED source 50 is shown including a logic power circuit preferably implemented by means of a micro-processor 52 or by means of one or more integrated circuits or by means of a combination of integrated circuits and a microprocessor.

The unit 52 is connected to the supply unit 45 via two power-lines +Vcc and GND and it is adapted to read the information available on signal bus 1*a*, 1*b*, 1*c* and to convert the level of the signal available on the two power lines +Vcc and GND for carrying brightness intensity and/or chromtic information for said light emitting diodes. In case of driving brightness intensity and chromatic information, the number of signal lines is increased in order to include a number of signal lines between four to six signal lines.

The supply unit 45 also includes a brightness control block 47 that causes the brightness variations of the source 50 using a PWM modulation technique on three switches namely a, b, and c: this is essentially the same arrangement described in the foregoing in connection with the "passive" source of FIG. 3. Opening/closing the switches a, b, and c essentially gives rise to three brightness information signals that reach the RGB LED source 50 (and more to the point the micro-processor 52 via three "signal" lines 1*a*, 1*b* and 1*c*.

Essentially in line with the "active" arrangement of FIG. 2, the micro-processor 52 of the arrangement of FIG. 4 works as interface between the supply unit 45 and the block 54 including the LEDs RD, GD, BD. The output signals from the brightness control block 47 are fed via the three information-lines 1*a*, 1*b*, 1*c*, to three input gates of the micro-processor 52. Based on the signals received over the lines 1*a*, 1*b*, and 1*c*, the micro-processor 52 calculates three current values to be delivered to the respective LEDs RD, GD, BD in the block 54.

The logic-power circuit elaborates the information of the signals 1*a*-1*c* in such a way that brightness intensity and/or chromatic information are converted into a suitable internal signal. This signal is then sent to a voltage-to-current conversion stage that, having Vcc as input, drives accordingly any of the LEDs RD-BD in the block 54."

When connected to an "active" source 50, the arrangement illustrated in FIG. 4 operates thus in a similar way to the arrangement of FIG. 2, with the micro-processor 52 able to decode the information signals coming from the control block 47 in order to control the current to be delivered to the loads (RD, GD, BD diodes).

Direct comparison of FIG. 3 and FIG. 4 shows that the supply unit 45 of FIG. 4 is also in a position to drive a "passive" source 40 as shown in FIG. 3, with the power line GND remaining unused.

The supply unit of FIG. 4 can thus be used indifferently to drive both an "Active" and a "Passive" source.

Without prejudice to the underlying principles of the invention, the details and the embodiments may vary, also appreciably, with reference to what has been described by way of example only, without departing from the scope of the invention as defined by the annexed claims.

Therefore, while a particular embodiment of the present invention has been shown and described with specific attention paid to its possible use in driving RGB LED sources, it should be understood that the present invention is not limited thereto since other embodiments may be made by those skilled in the art without departing from the scope thereof. It is thus contemplated that the present invention encompasses any such embodiments including the driving of a multichromatic lighting system, e.g. a tunable-whit lighting system.

The invention claimed is:

1. A driving arrangement for driving a lighting source comprising a plurality of light emitting diodes, the driving arrangement comprising:

a first power supply line (Vcc) and a set of signal lines for carrying information for said plurality of light emitting diodes, the driving arrangement further including:

a second power supply line (GND) to provide jointly with said first power supply line (Vcc) a two-wire power supply, and a switching block to generate switching signals to provide driving information for said plurality of light emitting diodes via said set of signal lines wherein the driving arrangement is configured to drive an active lighting source in such a way that power is supplied to the active lighting source via the first and second power supply lines and driving information is provided on the signal lines, and wherein the driving arrangement is further configured to drive a passive lighting source in such a way that switching signals to drive the light emitting diodes of the passive lighting source are supplied via the first power line and the signal lines and that the second power supply line is not used to drive the passive lighting source.

2. The driving arrangement of claim 1, characterized in that said driving information is brightness intensity information.

3. The driving arrangement claim 1 characterized in that said driving information is chromatic information.

4. The driving arrangement of claim 1 characterized in that said driving information is a combination of brightness intensity and chromatic information.

5. The driving arrangement of claim 1 further comprising a lighting source including a plurality of light emitting diodes coupled to a micro-processor for driving said plurality of light emitting diodes as a function of said driving information provided by said switching signals generated by said switching block and applied to said micro-processor via said set of signal lines, wherein said first (Vcc) and second (GND) power supply lines jointly supply power to said micro-processor.

6. The driving arrangement of claim 1 further comprising a lighting source including a plurality of light emitting diodes wherein the brightness of said plurality of light emitting diodes is controlled by said switching signals generated by said switching block and applied to said plurality of light emitting diodes via said first (Vcc) power supply line and said set of signal lines.

7. The driving arrangement of claim 6, wherein said plurality of light emitting diodes are coupled to respective current regulators.

8. The driving arrangement of claim 5, wherein said plurality of light emitting diodes jointly define a trichromatic lighting system.

9. The driving arrangement of claim 5, wherein said plurality of light emitting diodes jointly define a multichromatic lighting system.

10. The driving arrangement of claim 9, wherein said plurality of light emitting diodes jointly define an RGB lighting system.

11. The driving arrangement of claim 9, wherein said plurality of light emitting diodes jointly define a tunable-white lighting system.

12. The driving arrangement of claim 1, wherein said set of signal lines includes three signal lines.

13. The driving arrangement of claim 1, wherein said set of signal lines includes a number of signal lines between four to six signal lines.

14. The driving arrangement of claim 2 further comprising a lighting source including a plurality of light emitting diodes wherein the brightness of said plurality of light emitting diodes is controlled by said switching signals generated by said switching block and applied to said plurality of light emitting diodes via said first (Vcc) power supply line and said set of signal lines.

15. The driving arrangement of claim 3 further comprising a lighting source including a plurality of light emitting diodes wherein the chromaticity of said plurality of light emitting diodes is controlled by said switching signals generated by said switching block and applied to said plurality of light emitting diodes via said first (Vcc) power supply line and said set of signal lines.

16. The driving arrangement of claim 6, wherein said plurality of light emitting diodes jointly define a trichromatic lighting system.

17. The driving arrangement of claim 7, wherein said plurality of light emitting diodes jointly define a trichromatic lighting system.

18. The driving arrangement of claim 6, wherein said plurality of light emitting diodes jointly define a multichromatic lighting system.

19. The driving arrangement of claim 7, wherein said plurality of light emitting diodes jointly define a multichromatic lighting system.

20. The driving arrangement of claim 2 further comprising a lighting source including a plurality of light emitting diodes coupled to a micro-processor for driving said plurality of Light emitting diodes as a function of said brightness intensity provided by said switching signals generated by said switching block and applied to said micro-processor via said set of signal lines, wherein said first (Vcc) and second (GND) power supply lines jointly supply power to said micro-processor.

21. The driving arrangement of claim 3 with a lighting source including a plurality of light emitting diodes coupled to a micro-processor for driving said plurality of light emitting diodes as a function of said chromatic information provided by said switching signals generated by said switching block and applied to said micro-processor via said set of signal Lines, wherein said first (Vcc) and second (GND) power supply Lines jointly supply power to said micro-processor.

* * * * *